US005101534A

United States Patent [19]

Watanabe et al.

[11] Patent Number: 5,101,534

[45] Date of Patent: Apr. 7, 1992

[54] SUCTION NOZZLE WITH ROTARY BRUSH FOR VACUUM CLEANER

[75] Inventors: Syuji Watanabe, Toukai; Susumu Satoh, Takahagi; Koichi Sagawa, Hitachi, all of Japan

[73] Assignee: Hitachi, Ltd., Tokyo, Japan

[21] Appl. No.: 662,363

[22] Filed: Feb. 28, 1991

Related U.S. Application Data

[63] Continuation of Ser. No. 338,859, Apr. 17, 1989.

[51] Int. Cl.[5] ..... A47L 5/36

[52] U.S. Cl. ..... 15/377; 15/401; 15/420

[58] Field of Search ..... 15/377, 401, 420

[56] References Cited

U.S. PATENT DOCUMENTS

| | | | |
|---|---|---|---|
| 2,324,111 | 7/1943 | Ross | 15/325 X |
| 2,717,409 | 9/1955 | Draudt | 15/419 X |
| 2,846,711 | 8/1958 | Brace | 15/325 X |
| 2,930,069 | 3/1960 | Kowalewski | 15/419 X |
| 3,019,462 | 2/1962 | Nash et al. | 15/419 X |
| 3,950,815 | 4/1976 | Fukuchi et al. | 15/419 X |
| 4,204,297 | 5/1980 | Yasunaga et al. | 15/377 X |
| 4,416,034 | 11/1983 | Ahlf et al. | 15/419 X |
| 4,499,628 | 2/1985 | Platt | 15/419 |
| 4,817,233 | 4/1989 | Waldhauser | 15/401 X |

FOREIGN PATENT DOCUMENTS

| | | | |
|---|---|---|---|
| 1815059 | 8/1970 | Fed. Rep. of Germany | 15/420 |
| 112159 | 8/1977 | Japan . | |
| 120824 | 9/1980 | Japan . | |

*Primary Examiner*—Chris K. Moore

*Attorney, Agent, or Firm*—Antonelli, Terry, Stout & Kraus

[57] ABSTRACT

A front side flexible member is provided along the vicinity of an opening front edge of a suction opening of a suction nozzle main body and has a plurality of opening grooves. The flexible member is positioned at a dent wall of the suction nozzle main body. A suction guide wall is formed between the flexible member and the suction opening of the suction nozzle main body. The suction guide wall is positioned at a dent portion more than a bottom face of the suction nozzle main body. The large size solid dust at the corner portion is moved smoothly into the suction opening and the cleaning operation with the large size solid dust at the corner portion is carried out thoroughly.

2 Claims, 7 Drawing Sheets

SUCTION NOZZLE WITH ROTARY BRUSH FOR VACUUM CLEANER

This is a continuation of application Ser. No. 338,859, filed Apr. 17, 1989.

BACKGROUND OF THE INVENTION

The present invention relates to a suction nozzle with a rotary brush for a vacuum cleaner and, more particularly to a suction nozzle with a rotary brush for a vacuum cleaner suitable for cleaning a corner at a boundary portion of a surface to be cleaned such as the intersection between a wall and a floor.

In a conventional suction nozzle with a rotary brush for a vacuum cleaner, a flexible member is provided at the vicinity of a front edge of a suction opening formed in a suction nozzle main body as shown in, for example Japanese Patent Laid-Open No. 120824/1980.

This flexible member of the suction nozzle main body is projected to a position lower than a bottom face of the suction nozzle main body relative to the floor surface. The flexible member completely covers a clearance between the floor surface and the bottom face of the suction nozzle main body. The clearance is formed by the wheels attached at the bottom face of the suction nozzle main body.

The flexible member is caused to bend toward an inner portion of the suction nozzle main body by the suction force. The bending of the flexible member creates a small clearance between a lower end of the flexible member and the floor surface. When the small clearance is created the suction surface. When the small clearance is created the suction force into the suction nozzle main body is made weaker.

A lip shaped flexible member of a suction nozzle for a vacuum cleaner having no rotary brush has been known in, for example Japanese Utility Model Laid-Open No. 112159/1977, in which the flexible member is formed integrally with a bumper provided on an outer peripheral portion of the suction nozzle main body.

This flexible member is projected to a position lower than the bottom face of the suction nozzle main body. The flexible member may also be hung from the bumper so as to cover the lower portion of the front wall of the suction nozzle main body. The flexible member provides an inlet portion for the small space between the floor surface and the suction nozzle main body.

In the above stated former Japanese Patent Laid-Open No. 120824/1980, when the suction nozzle main body is moved with regard to the surface to be cleaned such as a floor surface in the forward direction, large size solid dust particles such as rice pellets, candy dust or peanuts are swept in the forward direction by the flexible member, which is projected to a position lower than the bottom face of the suction nozzle main body. Even though a rotary brush rotated by an electric motor is provided along with the suction force generated by the vacuum, it is still difficult to suck large size solid dust particles into the suction nozzle main body through the suction opening.

In particular, at the corners formed by intersections of the floor surface with the walls, large size solid dust particles being swept by the flexible member remain in the corners. Therefore there is a defect that the cleaning of the corners cannot be carried out thoroughly.

Further, in case of the cleaning of a carpet, friction resistance is large between the flexible member and the carpet. Still further since the air flowing into the suction opening of the suction nozzle main body is decreased and the negative pressure in the suction opening is increased, there is a defect that ease of movement of the suction nozzle main body is reduced being that it is now necessary to use an increased amount of force to move the suction nozzle main body.

In the above stated latter Japanese Utility Model Laid-Open No. 112159/1987, the lip shaped flexible member is projected to a position lower than the bottom face of the suction nozzle main body. Similar to the above stated Japanese Patent Laid-Open No. 120824/1980, the cleaning of large size solid dust particles cannot be carried out thoroughly and ease of movement of the suction nozzle main body is reduced.

In the above stated Japanese Utility Model Laid-Open No. 112159/1987, since the lip shaped flexible member formed integrally with the bumper is projected to a position lower than the bottom face of the suction nozzle main body, it is necessary to exchange the flexible member periodically with a new flexible member, because the lip shaped flexible member contacts the surface to be cleaned thereby subjecting the flexible member to wear. There is also a defect that it is necessary to exchange the bumper at the same time during the exchange of the flexible member since they are integrally formed.

The bumper is required to be made of a soft material and the lip shaped flexible member is required to be made of a material having some degree of hardness. However, since the bumper and the lip shaped flexible member are made integrally, there is a defect that both requirements cannot satisfied at the same time.

The suction nozzle main body is provided with a curved coupling turning portion in which the connection portion for an extension pipe is capable of turning in up and down directions and also in right and left directions. Electric power is supplied to the driving source of the rotary brush through the curved coupling turning portion. Due to the expected turning of the curved coupling turning portion, it is difficult to obtain a good electric connection for supplying electric power to the driving source.

There has been disclosed an electric power supply wiring structure for a power source line in a vacuum cleaner wherein the power source line is installed inside the base and extension pipe. This structure further provides that the power source line for the curved coupling turning portion be installed outside of the curved coupling turning portion. The power source line from outside of the curved coupling turning portion is then lead into the suction nozzle main body.

Further, there has been disclosed another electric power supply wiring structure for a power source line in a vacuum cleaner, in which the power source line is installed inside the hose and extension pipe. However, the electric wiring connection portion turns in only the up and down directions. Accordingly, there appears no electric power supply wiring structure for the vacuum cleaner in which the electric wiring connection portion can turn in all directions.

Since the conventional power source line is disposed outside of the curved coupling turning portion, when the suction nozzle main body is moved under a portion of furniture or a desk, movement of the suction main body may become obstructed by the power source line becoming caught by the furniture. If a large amount of force is applied to the power source line caught by the furniture the power source line is weakened thereby. Thus, the outside installation of the power source line may shorten the life of the power source line.

Further, in the conventional inside installation of the power source line, the turning of the curved coupling turning portion in only the up and down directions limits the use of the suction nozzle main body.

SUMMARY OF THE INVENTION

An object of the present invention is to provide a suction nozzle with a rotary brush for a vacuum cleaner wherein the cleaning of large solid dust particles at corners can be carried out thoroughly.

Another object of the present invention is to provide a suction nozzle with a rotary brush for a vacuum cleaner wherein high operability for the suction nozzle can be obtained.

A further object of the present invention is to provide a suction nozzle with a rotary brush for a vacuum cleaner wherein the cleaning can be carried out so as to move the large solid dust particles at corners into a suction opening of the suction nozzle main body.

A still further object of the present invention is to provide a suction nozzle with a rotary brush for a vacuum cleaner wherein the curved coupling turning portion of the suction nozzle main body can turn rotatively in the up and down directions and also in right and left directions.

A still further yet object of the present invention is to provide a suction nozzle with a rotary brush for a vacuum cleaner wherein the electric power supply wiring for the curved coupling turning portion of the suction nozzle main body is not disposed outside of the curved coupling turning portion.

In accordance with a suction nozzle of the present invention, a rotary brush for a vacuum cleaner comprises a suction nozzle main body being formed therein with a suction opening which opens toward a floor surface, a rotary brush provided in the suction nozzle main body that rotates facing the suction opening of the suction nozzle main body, and a front side flexible member mounted along a vicinity of an opening front edge of the suction opening of the suction nozzle main body.

A lower face of a front wall of the suction nozzle main body is curved to a position higher than a bottom face of the suction nozzle main body relative to the floor surface. The front side flexible member is attached to a portion of the curved front wall of the suction nozzle main body. The front wall includes a suction guide wall which is formed between the front side flexible member and the rotary brush and is curved toward the suction opening side of the suction nozzle main body. The front side flexible member includes a plurality of opening grooves or slits.

A protection cover is provided on an outside of the curved coupling turning portion for connecting the casing. The protection cover works together with the curved coupling turning portion. Electric power supply wiring (power source line) is disposed to have slack within the space formed by the protection cover and the curved coupling turning portion. The power source line is covered with the protection cover so that the power source line can move freely with respect to the movement of the curved coupling turning portion.

When electric power is supplied to the electric motor and the electric blower, the rotary brush rotates and suction air flow is generated in the suction opening provided in the suction nozzle main body. The surface to be cleaned is beaten by the rotary brush and by the suction air flow, and the dust, which is floated on the surface, is collected into the dust case of the vacuum cleaner main body through the a communicating passage, the curved coupling, an extension pipe and a hose.

When suction air flow is generated, the front side flexible member provided on the front portion of the suction opening in the suction nozzle main body becomes curved along the suction guide wall. The curved front of the side flexible member causes a small clearance between the front side flexible member and the surface to be cleaned to become larger. Further, since a plurality of opening grooves are provided on the front side flexible member, large sized solid dust particles such as a peanut is not swept thereby in the forward direction of movement of the suction main body as in conventional apparatus but is sucked smoothly into the suction opening due to the suction air flow.

Further, the lower surface of the suction guide wall of the suction nozzle main body is made to curve to a position higher than the bottom surface of the suction nozzle main body relative to the floor surface. The front side flexible member is attached to a portion of the curved front wall. The movement of large sized solid dust particles is not obstructed by the suction guide wall of the suction nozzle main body. Due to the longitudinal size of the front side flexible member the curve rate for deforming the front side flexible member can be made small. Further the operation force for moving the suction nozzle main body can be made small in the reverse and forward directions.

The electric power supply wiring for supplying electric power, is wired at the curved coupling turning portion, and is constructed so as to maintain the space which is formed between the curved coupling turning portion and the protection cover. The space includes no rib or boss and has a predetermined width.

Between the curved coupling turning portion and the casing, the wiring passage leading from the casing to the suction nozzle main body is made larger than the turning range of the curved coupling turning portion so as to permit the curved coupling turning portion to move freely with no restriction by the electric power supply wiring.

Even when the curved coupling turning portion moves in the up and down directions and also in the right and left directions, tension force is not added to the electric power supply wiring Since the electric power supply wiring can move freely, the electric power supply wiring is prevented from weakening or twisting due to movement of the curved coupling turning portion.

Accordingly, with the suction nozzle having a rotary brush for a vacuum cleaner structure of the present invention, the operation for the suction nozzle can be improved. Further a suction nozzle having a rotary brush for a vacuum cleaner can be obtained that can smoothly suck large sized solid dust particles at a corner position of a floor and wall intersection, into the suction opening of the suction nozzle main body by a strong suction force.

Figure 1:
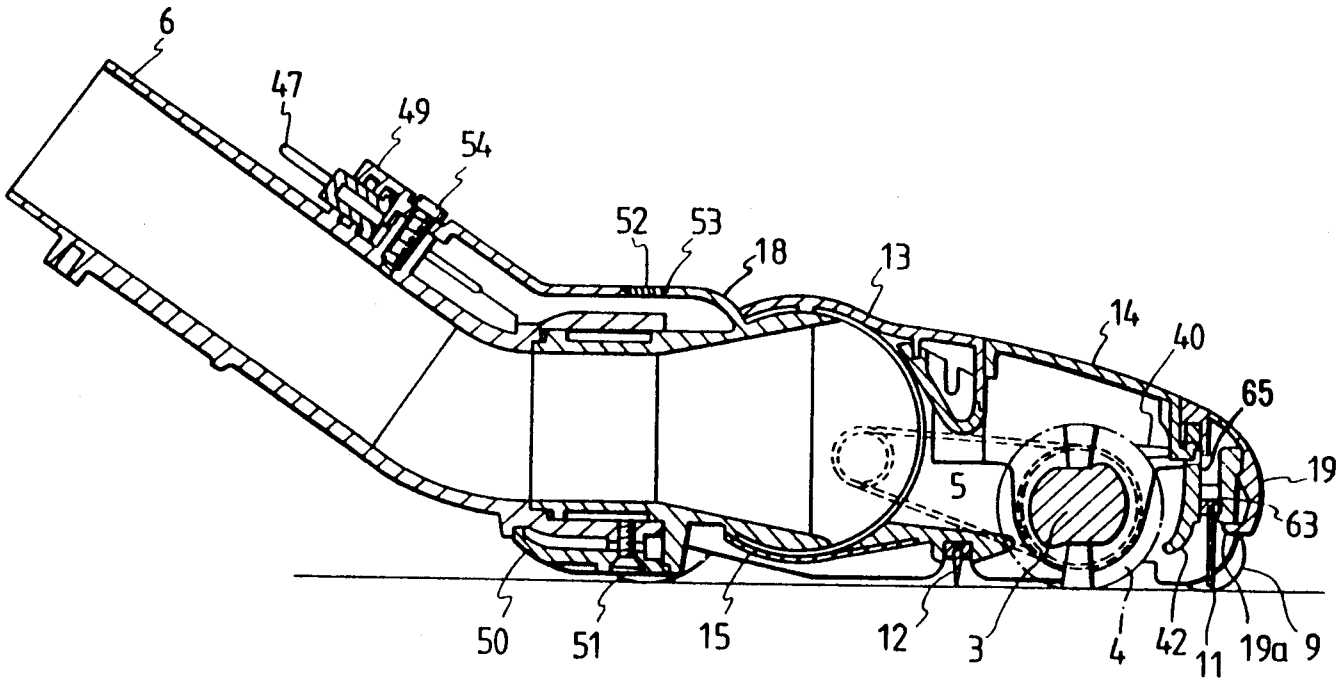
FIG. 1 is a vertical sectional view showing one embodiment of a suction nozzle with a rotary brush for a vacuum cleaner according to the present invention.
Figure 2:
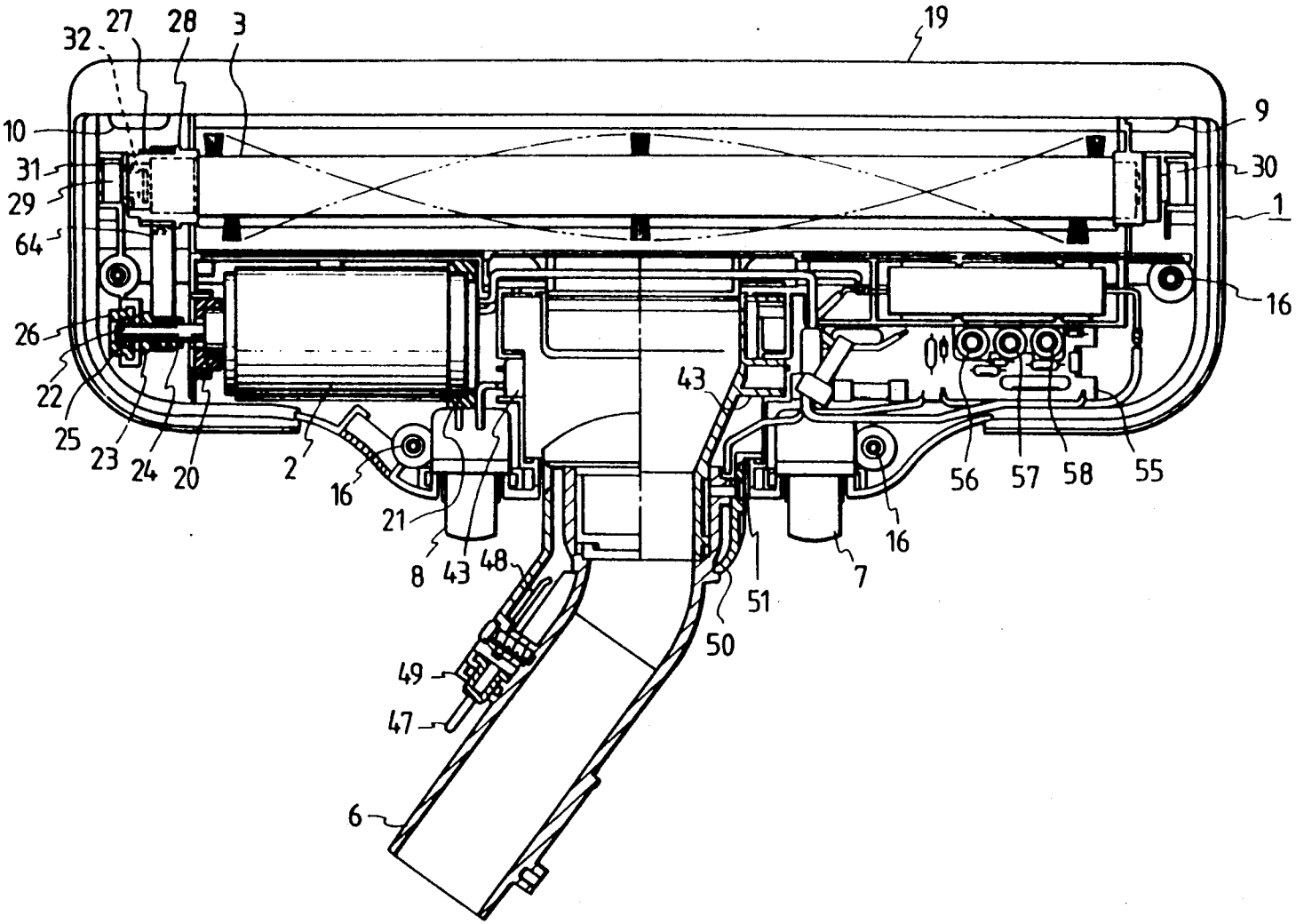
FIG. 2 is a part arrangement view in which an upper case and a suction port cover of the suction nozzle with a rotary brush are detached.

DETAILED DESCRIPTION OF THE INVENTION:

One embodiment of a suction nozzle with a rotary brush for a vacuum cleaner according to the present invention will be explained referring to drawings FIGS. 1-13.

In a suction nozzle main body 1 of a suction nozzle with a rotary brush for a vacuum cleaner, an electric motor 2 and a rotary brush 3 are provided at an internal portion thereof. At a bottom face of the suction nozzle main body 1, a suction opening 4 is formed. The elongated suction opening 4 opens toward a surface to be cleaned such as a carpet surface, a tatami mat surface or a floor surface etc.

At the rear of the suction nozzle main body 1, a curved coupling 6 is provided so as to turn in up and down directions or the right and left directions. A communicating passage 5 for communicating between the suction opening 4 and the curved coupling 6 is formed at an internal portion of the suction nozzle main body 1.

At the bottom portion of the suction nozzle main body 1, two large size wheels 7 and 8 are provided at the rear portion thereof, and further two small size wheels 9 and 10 are provided at the front portion thereof, respectively.

At the vicinity of the suction opening 4 provided on the bottom surface of the suction nozzle main body 1, a front side flexible member 11 and a rear side flexible member 12 are arranged respectively at the front side and the rear side of the suction opening 4. The flexible members 11 and 12 extend over respectively, the whole width of the suction opening 4 in the horizontal direction.

A lower face of a front wall 65 of the suction nozzle main body 1 is formed to be curved to a position higher than the bottom portion of the suction nozzle main body 1. The front side flexible member 11 is mounted detachably at a portion 63 of the front wall 65.

The suction nozzle main body 1 comprises an upper case 13 made of synthetic resins material which constitutes an upper surface, a suction port cover 14 made of synthetic resins material, and a lower case 15 made of synthetic resins material which constitutes a bottom surface. The lower case 15 is fitted to the upper case 13 by screws 16. The suction port cover 14 is attached detachably with the upper case 13 and the lower case 15.

Interior components includes the electric motor 2, the rotary brush 3, a nozzle piece 17 provided in the communicating passage 5, and a casing 18 which supports rotatively the curved coupling 6 for movement in the up and down directions, wherein each of the components is installed in the suction nozzle main body 1, respectively. The interior components are sandwiched and fixed between the upper case 13 and the lower case 15.

A bumper 19, which is installed so as to surround the outer peripheral portion of the casing 18, is also sandwiched and fixed between the upper case 13 and the lower case 15. The curved coupling 6 is supported rotatively within the casing 18 for movement in the right and left directions and the up and down directions. Accordingly, the curved coupling 6 can turn with the suction nozzle main body 1 in the up and down directions and also in the right and left directions.

The electric motor 2 is supported in the suction nozzle main body 1 in a rubber-vibration state through two rubber cushion insulator members 20 and 21. A first pulley 24 having a first flange portion 23, a bearing 25, and a bearing cover 26 for receiving the bearing 25 with the lower case 15 are provided at the end portion of a rotative shaft 22 of the electric motor 2.

A second pulley 27 having a second flange portion 28 is provided at the end portion of the rotary brush 3. The first pulley 24 and the second pulley 27 have the same tooth forms. However, the first and second pulleys 24 and 27 respectively are made to have different numbers of teeth. The first flange portion 23 of the first pulley 24 is positioned at the side wall portion side of the suction nozzle main body 1. The second flange portion 28 of the second pulley 27 is positioned at the suction opening 4 side of the suction nozzle main body 1, which is opposite to the first flange portion 23.

Bearings 29 and 30 of the rotary brush 3 are mounted to both end portions of the rotary brush 3. A projection member 31 of the rotary brush bearing 29 is disposed within a curved portion of the second pulley 27. The projection member 31 and a projection member 32 are disposed in a normal position after press fitting thereof. The rotary brush bearing 30 is rotatively supported by the inner surface of the suction nozzle main body 1.

A timing belt 64 is put up between the first pulley 24 and the second pulley 27, so that the driving power of the electric motor 2 is transmitted to the rotary brush 3. The rotary brush 3 is made of urethane foam material and provides a plurality of spirally formed brushes 33 and a spirally projected beating projection member 34.

Two clamps 35 are mounted at both end portions of the suction port cover 14 of the rotary brush 3. The rotary brush 3 is held in the inner surface of the suction port cover 14 so as to be taken out together when the suction port cover 14 is removed. Each clamp 35 comprises a clamp portion 37 and a projection slip member 39. The clamp portion 37 fits with a projection member 36 so as to detachably fix the suction port cover 14 to the upper case 13.

The projection slip member 39 is hooked and fixed with a fixing curved portion 38 which is provided on the lower case 15. A bearing presser bar spring 40 is provided on the suction port cover 14 at the upper portions of the rotary brush bearings 29 and 30.

Figure 3:
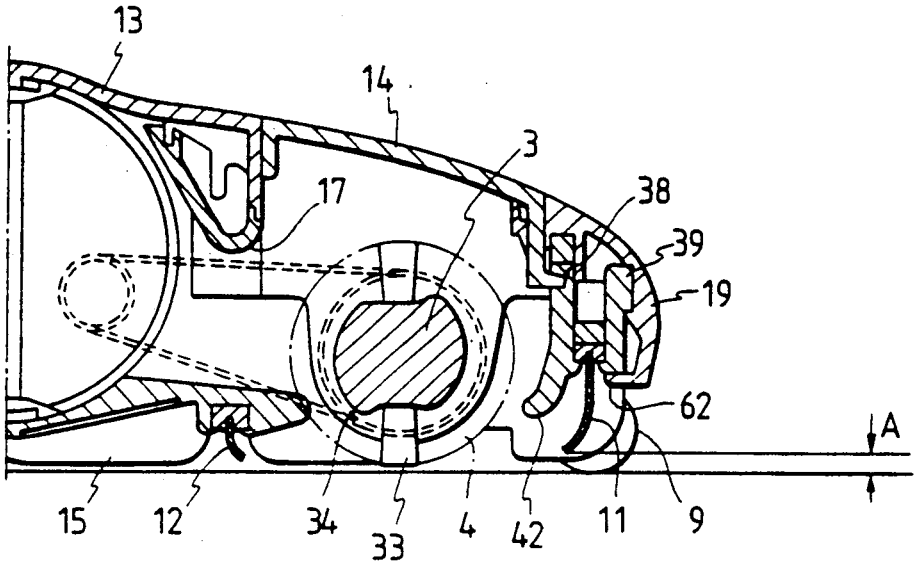
FIG. 3 is an enlarged sectional view showing an essential portion of a suction nozzle main body having a front side flexible and a suction guide wall.
Figure 4:
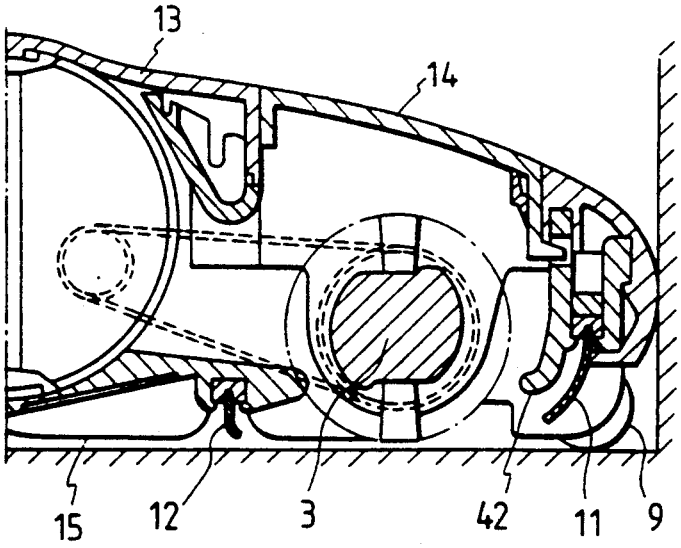
FIG. 4 is an essential sectional view in which a suction nozzle main body contacts to the wall etc.
Figure 6:
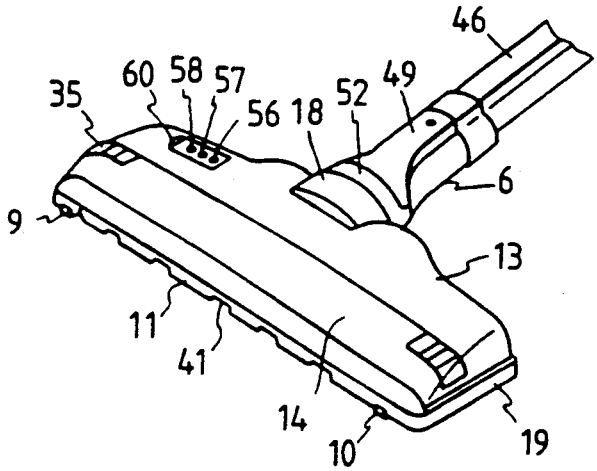
FIG. 6 is an outside appearance view showing a suction nozzle main body.

At the lower case 15 side of the front portion of the suction opening 4 of the suction nozzle main body 1, the front side flexible member 11 and a suction guide wall 42, included in the front wall 65, are provided as shown in FIGS. 3, 4 and 6. The front side flexible member 11 has a plurality of indentations and notches forming opening grooves or slits 41. The suction guide wall 42 is curved toward the suction opening 4 in the suction nozzle main body 1. The length of the front side flexible member 11 is set to be longer than the lower end of the suction guide wall 42.

A bumper 19 is provided on the front of the suction nozzle main body. The bumper is attached to the suction port cover 14 and the lower case 15. An end portion 19*a* of the bumper 19 is provided with a contact point. At the rear portion of the suction opening 4 of the suction nozzle main body 1, the rear side flexible member 12 is provided in parallel with a lateral width direction of the suction opening 4. The length of the rear side flexible member 12 is set to be shorter than that of the front side flexible member 11.

The suction opening 4 of the suction nozzle main body 1 communicates with the casing 18 and the curved coupling 6 through the communicating passage 5 in the suction nozzle main body 1. The casing 18 is supported rotatively with the rotative shaft 43, and the casing 18 and the curved coupling 6 are constituted so as to permit movement rotatively in the right and left directions, respectively.

Connecting pins 47 are provided on the curved coupling 6. The connecting pins 47 are connected so as to supply the electric power from the vacuum cleaner main body 44 to the electric motor 2 through a hose 45 and an extension pipe 46.

Lead wires 48 are wired from the connecting pins 47. A first protection cover 49 and a second protection cover 50 for protecting the lead wires 48 are provided respectively with the covering for the curved coupling 6. A space is formed between the first protection cover 49 and the curved coupling 6, thereby permitting the lead wires 48 to move freely with the movements of the curved coupling 6.

The first protection cover 49 and the second protection cover 50 are constituted as follows. A part of the second protection cover 50 is fixed to the curved coupling 6 by screws 51. The second protection cover 50 has a tube shaped body 52 and is connected with the casing 18. The first protection cover 49 is overlapped toward the casing 18 by a faucet joint member 53. After the first protection cover 49 has been fixed to the tube shaped body 52, the first protection cover 49 is fixed also to the curved coupling 6 by screws 54.

Figure 7:
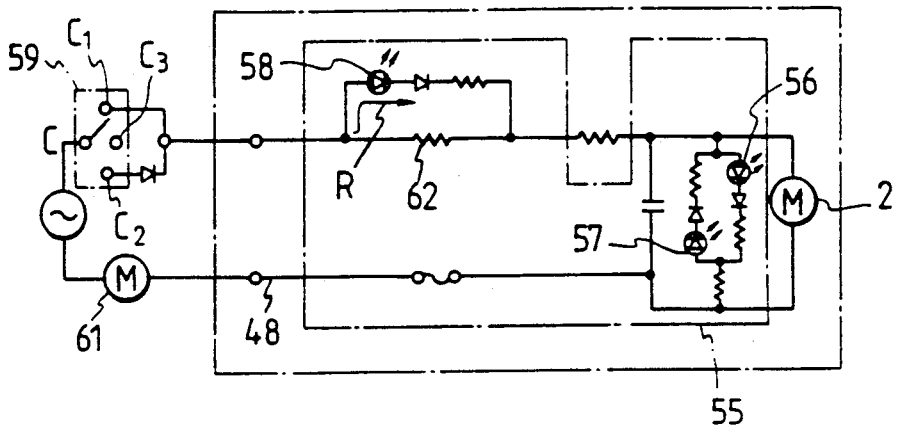
FIG. 7 is an electric circuit diagram of one embodiment according to the present invention.

The lead wires 48 supplies the electric power according to the wiring of an electric circuit diagram shown in FIG. 7. Three LED (light emitting diode) lamps 56, 57 and 58 disposed on a substrate plate 55, which is arranged in the electric wiring. The LED lamps are wired not to output light when the rotary brush 3 stops, and to output light one by one by a switch 59 disposed at the tip of the hose 45 in accordance with the rotation of the rotary brush 3. The light-on or the light-off of the three LED lamps 56, 57 and 58 is confirmed through a display portion 60 provided on the upper case 13.

Figure 5:
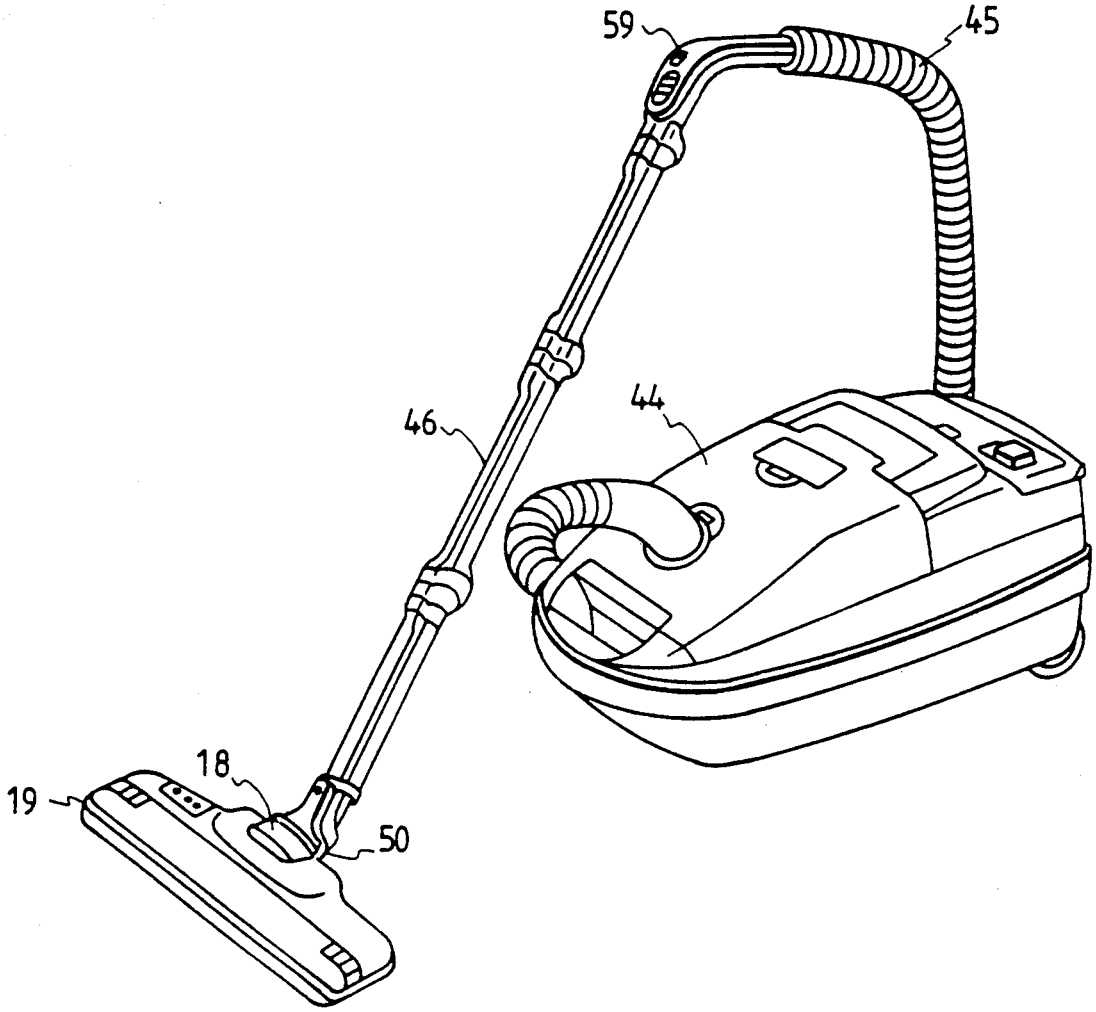
FIG. 5 is an outside appearance view in which a suction nozzle main body is mounted on a vacuum cleaner main body.

With the above stated suction nozzle for a vacuum cleaner structure of the present invention, in case of a cleaning operation, each of the components are connected as shown in FIG. 5. When the switch 59 disposed at the tip of the hose 45 is turned to the on condition toward a terminal $C_1$ side the LED lamp 56 (green) of the display portion 60, in accompany with the start of operation of an electric blower 61 (shown in FIG. 7) of the vacuum cleaner main body 44 and the electric motor 2 of the suction nozzle main body 1, of the vacuum cleaner is turned on. With this condition, the rotary brush 3 rotates at a low speed. This cleaning operation is suitable for thin carpet and the tatami mat etc..

Next, when the switch 59 is turned to the on condition toward a terminal $C_2$ the electric motor 2 in the suction nozzle main body 1 rotates at a high speed causing the rotary brush 3 to rotate at a high speed similarly. The two LED lamps 56 (green) and 57 (green) are turned on. This cleaning operation is suitable for thick carpet.

The LED lamp 58 (red) is connected to a positive characteristic thermistor 62 as shown in an electric circuit diagram of FIG. 7. In a situation where the rotary brush 3 drags in foreign matter etc. which causes a locking condition for the rotation of the rotary brush, the thermistor 62 of the LED lamp 58 (red) senses an exothermic condition of the vacuum cleaner and increases its resistance value thereof. The increased resistance causes an electrical current which normally flows in the direction of the thermistor 62 to flow in the direction of the LED lamp 58 (red) as shown by an arrow R in FIG. 7. The LED lamp 58 (red) is turned on and the operator can notice such an abnormal condition. When the LED lamp 58 (red) is turned on, then the LED lamps 56 (green) and 57 (green) are turned off.

When the switch 59 is switched toward a terminal $C_3$ as shown in FIG. 7, the electric power supply to the electric motor 2 and the electric blower 61 shuts off, and the cleaning operation is stopped. The rotating speed of the electric motor 2 when the switch 59 is set to the on condition toward the terminal $C_2$ of FIG. 7, is about 75% of the rotating speed of the electric motor 2 when the switch 59 is set to the on condition toward the terminal $C_1$ of FIG. 7.

When the operator wishes to clean the surface of a floor or a tatami mat etc. by use of the suction nozzle and the vacuum cleaner is not in an operational state, the front side flexible member 11 and the rear side flexible member 12, which are disposed respectively at the front portion and the rear portion of the suction opening 4 of the suction nozzle main body have lengths which causes the members 11 and 12 to contact the surface to be cleaned as shown in FIG. 1. When the vacuum cleaner is in an operational state the front side flexible member and the rear side flexible member 12 are curved respectively by the suction air flow being generated by the vacuum cleaner main body 44 as shown in FIG. 3.

A clearance A between the front side flexible member 11 or the rear side flexible member 12 and the surface to be cleaned due to bending of the flexible members 11 and 12 respectively during operation of the vacuum cleaner varies according to the air quantity being sucked into the vacuum cleaner main body 44. In a case where the air quantity sucked into the vacuum cleaner main body 44 is large, in other words in a case where the condition that the filter member in the vacuum cleaner main body 44 is not blocked, the clearance A becomes large. In a case where the air quantity sucked into the vacuum cleaner main body 11 is small due to the blocking of the filter member in the vacuum cleaner main body 44, the clearance A becomes small. The air flow velocity flowing into the suction opening 4 of the suction nozzle main body 1 is made constant with the change of clearance A.

The cross-sectional areas of a plurality of the opening grooves 41 formed on the front side flexible member 11 are set according to the following fact. The pressure distribution of a conventional vacuum cleaner having a suction nozzle is high at the central portion and low at both end portions as shown in the curve line P in FIG. 10. In the vacuum cleaner having a suction nozzle of the present invention, the pressure distribution is made nearly the same amount throughout the overall lateral width of the suction nozzle as shown by curve line Q in FIG. 10.

Figure 8:
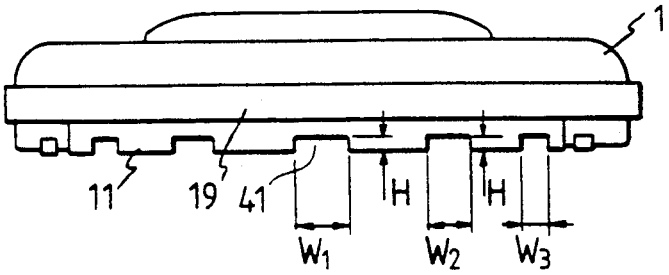
FIG. 8 is a front view showing one embodiment of a suction nozzle main body having a front side flexible member.

One embodiment of the cross-sectional areas of the front side flexible member 11 is to have the heights of the cross-sectional areas constant but the widths $W_1$, $W_2$, $W_3$ of the cross-sectional areas smaller in proportion to its distance toward both ends of the front side flexible member 11 as shown in FIG. 8.

Figure 9:
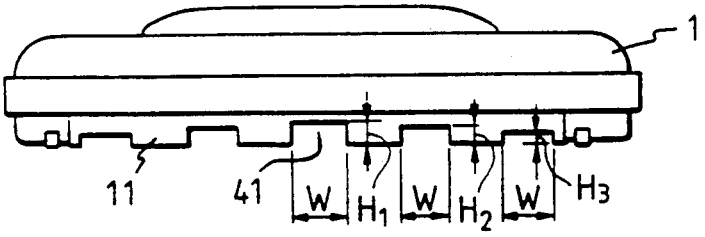
FIG. 9 is a front view showing another embodiment of a suction nozzle main body having another front side flexible member.

Another embodiment of the cross-sectional areas of the front side flexible member 11 is to have the width W of the cross-sectional areas constant but the heights $H_1$, $H_2$, $H_3$ of the cross-sectional areas smaller in proportion to its distance toward both ends of the front side flexible member 11 as shown in FIG. 9.

Figure 10:
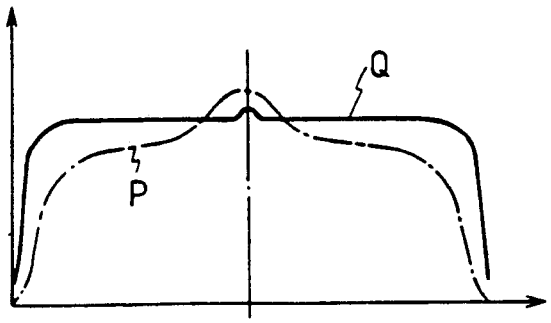
FIG. 10 are static pressure distribution graphs in a suction opening according to the conventional art and the present invention.
Figure 11:
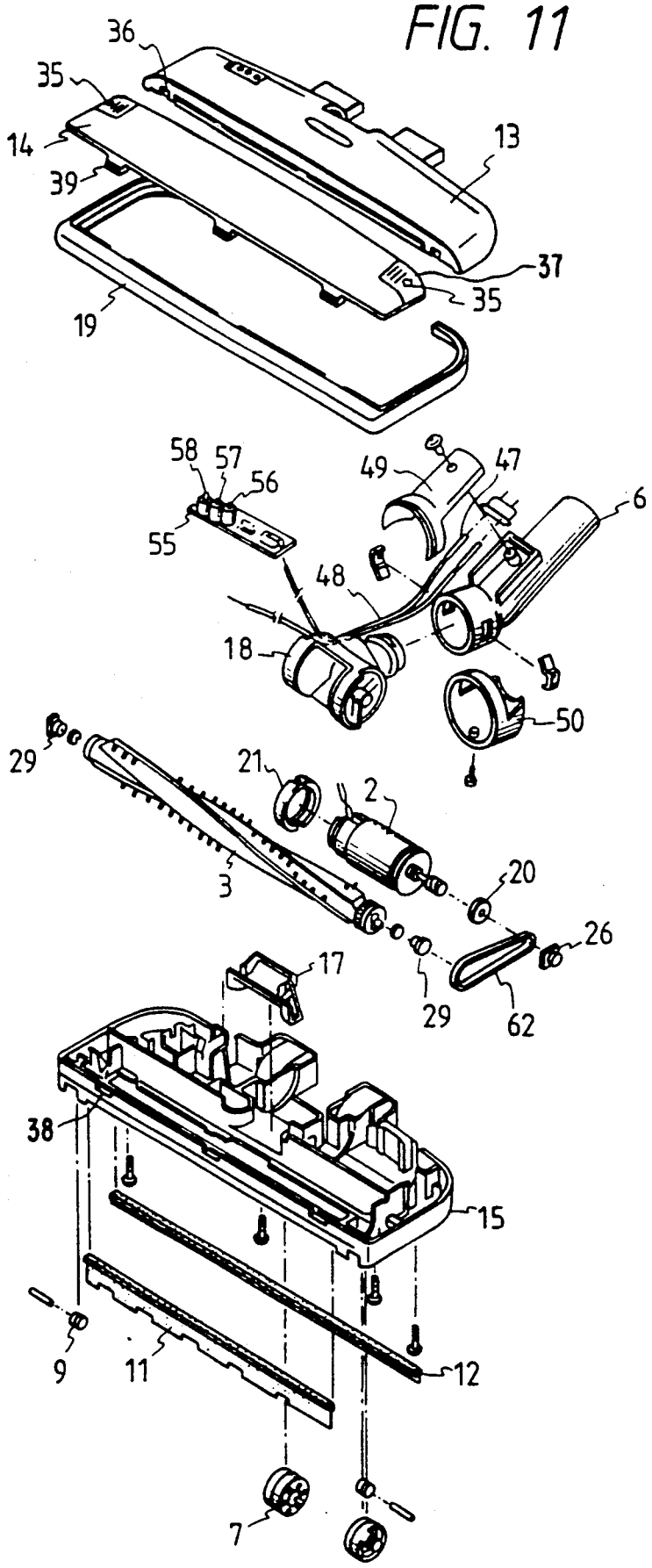
FIG. 11 is an exploded view showing a suction nozzle main body according to one embodiment of the present invention.
Figure 12:
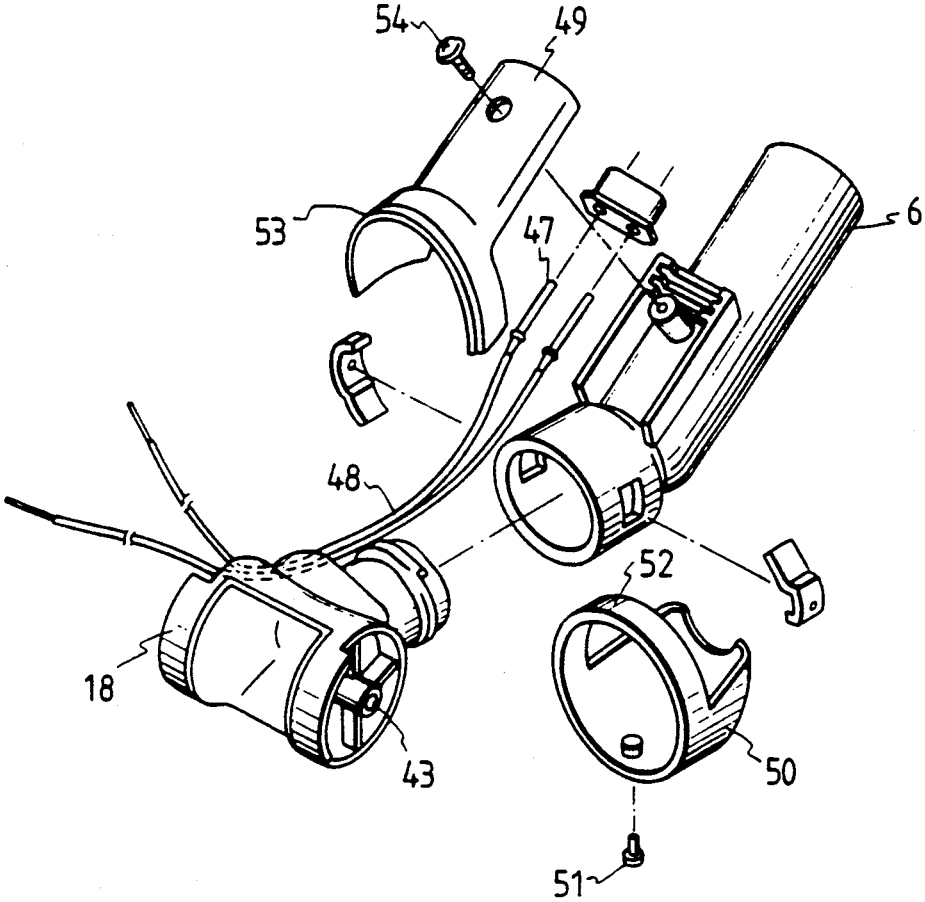
FIG. 12 is an exploded view showing a bent coupling turning portion of a suction nozzle main body.
Figure 13:
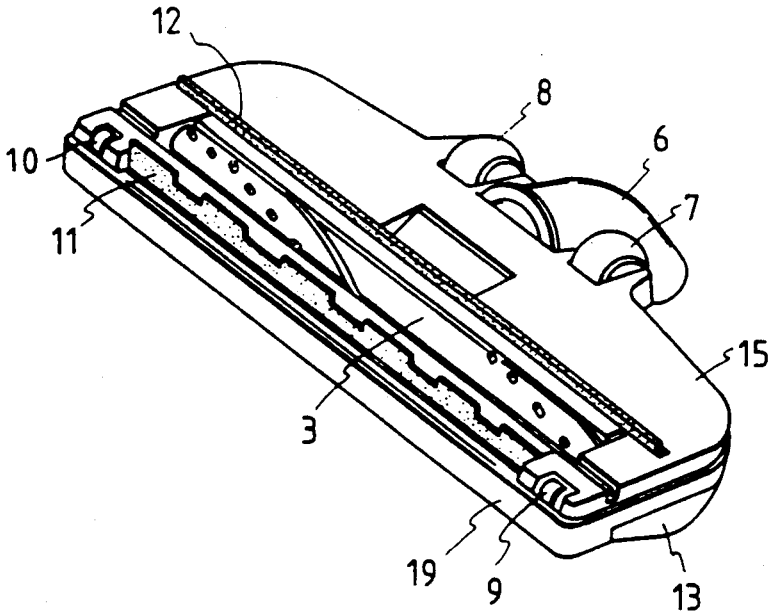
FIG. 13 is an outside appearance showing a back side of a suction nozzle main body according to one embodiment of the present invention.

By the pressure distribution shown in the curve line Q in FIG. 10, in the present invention, a strong suction force can be generated along the complete length of the suction opening 4 of the suction nozzle main body 1.

When the operator wishes to clean the carpet etc. by use of the rotary brush 3, since the front side flexible member 11 of the suction nozzle main body 1 is attached to the curved portion 63 which is positioned at a point higher than the bottom surface of the suction nozzle main body 1 relative to the floor surface, the operation of the suction nozzle main body 1 is made easier and more smooth.

For example, even when the front side flexible member 11 contacts with the fibers of the carpet, it is possible to easily and smoothly operate the suction nozzle main body 1 because the resistance from the carpet is made small.

The suction guide wall 42, which is disposed between the front side flexible member 11 and the suction opening 4, is to be curved toward the inside of the suction nozzle main body 1. The suction guide wall 42 does not block the movement of the front side flexible member 11 when the front side flexible member is caused to curve toward the suction opening 4 due to suction air force.

Also the front side flexible member 11 is prevented from contacting the rotary brush 3. This potential contact may be due to contact cf the front side flexible member 11 with a threshold in the floor surface or the floor surface itself. Contact of the flexible member 11 with the rotary brush 3 is prevented by the provision of the suction guide wall 42. Thus carpet having long fibers such as shag type carpet is prevented from twining in the rotary brush 3 by the provision of the suction guide wall 42.

When the bumper 19 provided on the front surface of the suction nozzle main body 1 collides with a wall or furniture in the room, the bumper 19 deforms. A lower end portion 62 of the bumper 19 and the portion 63 to which the front side flexible member 11 is attached are pushed respectively toward the inside thereof.

Since the clearance A between the front side flexible member and the surface to be cleaned is made larger irrespective of the suction air amount due to the push thereof by the bumper 19, large sized solid dust particles such as peanuts are not left behind in the corners of the room and is sucked smoothly into the suction opening 4 of the suction nozzle main body 1.

Further, the front side flexible member 11 is provided on the axis line of the small wheels 9 and 10, so that even when uneven portions exists on the surface to be cleaned, the clearance A between the front side flexible member 11 and the surface can be maintained at a constant.

When the front side flexible member 11 is curved toward the inside portion thereof by the suction air force generated at the suction opening 4 of the suction nozzle main body 1, the tip of the front side flexible member 11 covers a part of the suction opening 4. Therefore, the opening area of the suction opening 4 is made small and since the suction force is strengthen, the large sized solid dust particles can be sucked more smoothly into the suction opening 4 of the suction nozzle main body 1.

When the front side flexible member 11 is worn out, and being that the front side flexible member 11 is made separately from the bumper 19 and mounted detachably at the curved portion 63 of the front wall 65 of the suction nozzle main body 1, the front side flexible member 11 can be changed easily and independently of the bumper 19.

Since the front side flexible member 11 is disposed at the curved portion 63 which is provided further at a position set back from the bottom surface of the suction nozzle main body 1, the curve rate for deforming the front side flexible member 11 comprising an elastic material can be made small. The life of the member 11 due to the bending of the front side flexible member 11 can be increased by not applying large forces being applied at a position attached to the position 63. Further, the force for operating the suction nozzle main body 1 in the back and forth directions can be lessened.

The suction guide wall 42 disposed at the rear (suction port side) of the front side flexible member 11 is disposed in an incline toward the suction opening 4. Therefore, even when the front side flexible member 11 contacts a projection portion (the edge portion of the carpet, the step of the threshold etc.) of the surface to be cleaned and is bent inside thereof by pushing, the front side flexible member 11 can be prevented from contacting with the rotary brush 3. Even when the front side flexible member 11 receives a force, the suction guide wall 42 works as a wall for receiving the force, thereby preventing the front side flexible member 11 from tearing or being injured by the rotary brush 3.

Further, shag carpet having long fibers clings easily to the rotary brush 3. In such a case, the suction guide wall 42 can prevent the long fibers from clinging to rotary brush 3 by pushing out of the way the long fibers of the shag carpet. Even further when carpet having long fibers is to be cleaned, the number of rotations of the rotary brush 3 can be decreased.

The rotary brush 3 can be set to the number rotations which is proper such as a high number of rotations or a low number of rotations. Even on the tatami mat, the cleaning is carried out at a low number of rotations of the rotary brush 3. Therefore, the cleaning on the tatami mat can carried out by maintaining a sweeping effect and the tatami mat is not injured.

Since the condition of the rotation of the rotary brush 3 is displayed at the upper portion of the suction nozzle main body 1, the operator can notice immediately the operating states, to determine whether the floor is injured by the rotation of the rotary brush 3, or whether the rotary brush 3 catches foreign matter and goes into a rotation locking condition. The rotary brush 3 can always be used with the normal rotation condition.

The rotary brush bearings 29 and 30 of the rotary brush 3 are held at a set pressure force with a predetermined constant direction. Even when an unbalance amount is generated in the rotary brush 3, the vibration noise in the rotary brush 3 caused by the above unbalance can be restrained.

Since the second flange portion 28 provided on the second pulley 27 of the rotary brush 3 is mounted toward the inside direction thereof, even in a case where the rotary brush 3 is detached, then the timing belt 64 is not hooked by the second flange portion 28 and can be detached smoothly so that maintenance of the suction nozzle main body 1 can be performed.

Further, since the power source line which projects from the curved coupling 6 toward the outside portion is covered, the power source line does not sway onto the lower portion of a desk or the leg of furniture. Therefore, it is possible to clean the surface to be cleaned at lower and narrow places and the safety for the power surface line is provided for.

Further, the curved coupling 6 of the suction nozzle main body 1 in the present invention is formed with the following structure. The shapes of the protection covers constituting the outside shell for the curved coupling 6 are formed to be engaged with the cylinder faucet portion 53 at the casing 18 and the upper and lower fitting structure are fit together at the curved coupling 6. Even when a large outside force is added to the curved coupling 6 the engagement portion thereof does not open the curved coupling 6, and further the fitting portion thereof does not slip out of place.

Further, since the internal lead wires 48 are arranged with slack therein, the internal lead wires 48 can move freely in the up and down directions and the right and left directions. Also the life of the internal lead wires 48 is improved greatly due to the slack provided therein.

We claim:

1. A suction nozzle with a rotary brush for a vacuum cleaner comprising:

a suction nozzle main body having a front wall, bottom face, top face and rear portion, said suction nozzle main body being formed with a suction opening in said bottom face, said suction opening opens toward a floor surface, said suction opening having a width in left and right directions substantially equal to a width in left and right directions of said suction nozzle main body and having a suction force applied therein when said vacuum cleaner is operated;

a rotary brush disposed rotatively in said suction nozzle main body adjacent to said suction opening of said suction nozzle main body; and a front side flexible member mounted along a front edge of said suction opening of said suction nozzle main body;

wherein said front wall of said suction nozzle main body projects towards said floor surface and includes a suction guide wall which curves toward said suction opening, wherein a distal end of said suction guide wall extends to a position higher than a bottom face of said suction nozzle main body relative to said floor surface, said front side flexible member is attached to a portion of said front wall of said suction nozzle main body;

wherein said suction guide wall projects from between said front side flexible member and said rotary brush, said suction guide wall extends toward said floor surface and has a width substantially equal to a width of said suction opening of said suction nozzle main body;

wherein said suction guide wall is positioned apart from said front side flexible member so as to form a space between a front surface of said suction guide wall and a rear surface of said front side flexible member, wherein a portion of said front side flexible member extends beyond said distal end of said suction guide wall;

wherein when said suction force is applied to said suction opening, said suction force causes said front side flexible member to bend toward said suction opening causing said portion of said front side flexible member which extends beyond said distal end of said suction guide wall to cover a part of said suction opening thereby causing said suction force to increase;

wherein small wheels are arranged at portions which are at said bottom face of said suction nozzle main body and positioned at outside portions outside both ends of said front side flexible member; and wherein a plurality of opening grooves are provided on said front side flexible member.

2. A suction nozzle with a rotary brush for a vacuum cleaner comprising:

a suction nozzle main body having a front wall, bottom face, top face and rear portion, said suction nozzle main body being formed with a suction opening in said bottom face, said suction opening opens toward a floor surface, said suction opening having a width in left and right directions substantially equal to a width in left and right directions of said suction nozzle main body and having a suction force applied therein when said vacuum cleaning is operated;

a rotary brush disposed rotatively in said suction nozzle main body adjacent to said suction opening of said suction nozzle main body; and a front side flexible member mounted along a front edge of said suction opening of said suction nozzle main body;

wherein said front wall of said suction nozzle main body projects toward said floor surface and includes a suction guide wall which curves toward said suction opening, wherein a distal end of said suction guide wall extends to a position higher than a bottom face of said suction nozzle main body relative to said floor surface, said front side flexible member is attached to a portion of said front wall of said suction nozzle main body and provides a plurality of opening grooves, and said suction guide wall projects from between said front side flexible member and said rotary brush;

wherein, said suction guide wall extends toward said floor surface and has a width substantially equal to said width of said suction opening of said suction nozzle main body;

wherein, said suction guide wall is positioned apart from said front side flexible member so as to form a space between a front surface of said suction guide wall and a rear surface of said front side flexible member and a portion of said front side flexible member extends beyond said distal end of said suction guide wall; and wherein, when said flexible front side member bends along said suction guide wall, a part of said suction opening of said suction nozzle main body is covered by said portion of said front side flexible member which extends beyond said distal lower end of said suction guide wall.

* * * * *